US009133637B1

(12) United States Patent
O'Brien

(10) Patent No.: US 9,133,637 B1
(45) Date of Patent: Sep. 15, 2015

(54) GUY/GUIDE WIRE ANCHOR PROTECTOR

(71) Applicant: Ryan Donald O'Brien, Belfield, ND (US)

(72) Inventor: Ryan Donald O'Brien, Belfield, ND (US)

( * ) Notice: Subject to any disclaimer, the term of this patent is extended or adjusted under 35 U.S.C. 154(b) by 0 days.

(21) Appl. No.: 14/209,945

(22) Filed: Mar. 13, 2014

(51) Int. Cl.
*E02D 27/42* (2006.01)
*E04G 21/32* (2006.01)
*E04H 12/22* (2006.01)

(52) U.S. Cl.
CPC ..... *E04G 21/3252* (2013.01); *E04H 12/22* (2013.01); *E04H 12/2238* (2013.01); *E04H 12/2269* (2013.01); *E04H 12/2292* (2013.01)

(58) Field of Classification Search
CPC ..... E04H 12/2238; E04H 12/2269; E04H 12/2292; E04H 12/22; E04G 21/3252
USPC ..... 52/97, 148, 166, 147, 170
See application file for complete search history.

(56) References Cited

U.S. PATENT DOCUMENTS

| | | | | | |
|---|---|---|---|---|---|
| 1,070,663 | A | * | 8/1913 | Bierce | 52/166 |
| 1,433,621 | A | * | 10/1922 | Hutton | 52/166 |
| 1,659,527 | A | * | 2/1928 | Holmgreen | 52/166 |
| 1,756,534 | A | * | 4/1930 | Chance | 52/166 |
| 2,036,047 | A | * | 3/1936 | Hill | 52/166 |
| 2,252,379 | A | * | 8/1941 | Johns | 52/166 |
| 2,695,587 | A | * | 11/1954 | Welter | 114/300 |
| 3,070,068 | A | * | 12/1962 | Chapman | 119/786 |
| 4,634,120 | A | * | 1/1987 | Hall | 52/166 |
| 4,993,870 | A | * | 2/1991 | Bridgewater | 405/21 |
| 5,271,196 | A | * | 12/1993 | Fanti | 52/166 |
| D348,738 | S | * | 7/1994 | Jasinsky | D25/133 |
| 6,729,089 | B1 | * | 5/2004 | Spragg | 52/296 |
| D599,915 | S | * | 9/2009 | Godwin | D25/133 |

FOREIGN PATENT DOCUMENTS

JP 2000212968 A * 8/2000 ..... E02D 17/20

* cited by examiner

*Primary Examiner* — Adriana Figueroa
(74) *Attorney, Agent, or Firm* — Roylance, Abrams, Berdo & Goodman, L.L.P.

(57) ABSTRACT

A guy/guide wire anchor protector is provided to protect personnel and equipment in the oil and gas field. The anchor protector has a substantially truncated pyramid shape with an opening extending between a top face and a bottom face.

6 Claims, 4 Drawing Sheets

GUY/GUIDE WIRE ANCHOR PROTECTOR

FIELD OF THE INVENTION

This invention relates to the manufacture of metal covers to protect property and personnel from harm.

The invention relates particularly to guy/guide wire tie offs (dead man anchors) in the oil and gas industry.

BACKGROUND OF THE INVENTION

Guy/guide wire tie offs (dead man anchors) are widely used in the oil and gas industry to do maintenance to oil wells and are used to anchor work over rigs and other maintenance equipment. Typically the anchors are installed into the ground at a predetermined depth. They are pull tested and left for future maintenance operations. This has been standard practice in the oil and gas industry.

The anchor protrudes out of the ground approximately 4" to 6" inches. This causes a potential trip hazard to personnel on the site. It also causes the potential of a drive over hazard costing lost time and damage to motor vehicles and equipment.

BRIEF DESCRIPTION OF THE DRAWINGS

The following is a brief description of the drawings in which.

DETAILED DESCRIPTION OF THE INVENTION

Figure 1:
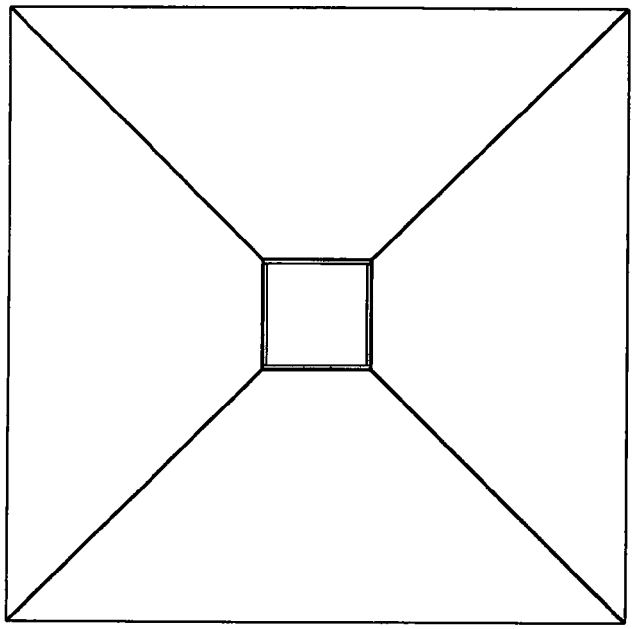
FIG. 1 is a top view of the anchor protector in one embodiment of the invention.
Figure 2:
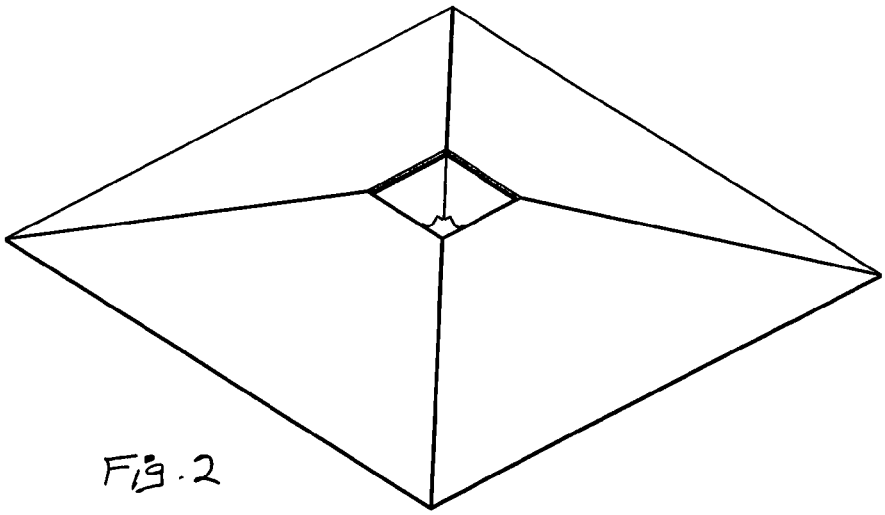
FIG. 2 is a top perspective view of the anchor protector of FIG. 1.
Figure 3:
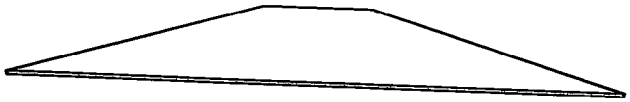
FIG. 3 is a side elevational view of the anchor protector.
Figure 4:
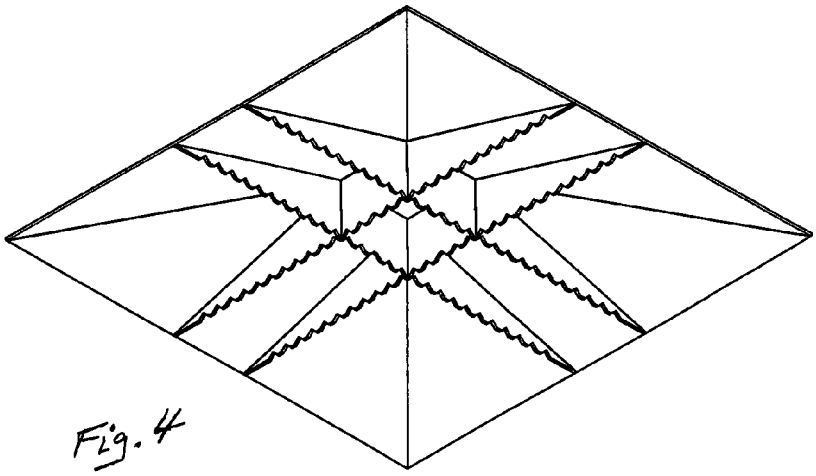
FIG. 4 is a bottom perspective view of the anchor protector.
Figure 5:
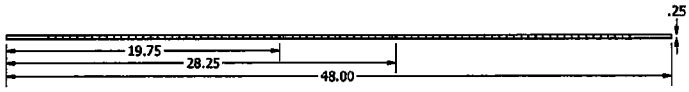
FIG. 5 is a bottom end view of the first reinforcing rib of the anchor protector of FIG. 1.
Figure 6:
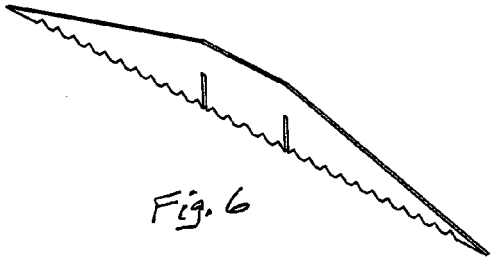
FIG. 6 is a perspective view of the reinforcing rib of FIG. 5.
Figure 7:
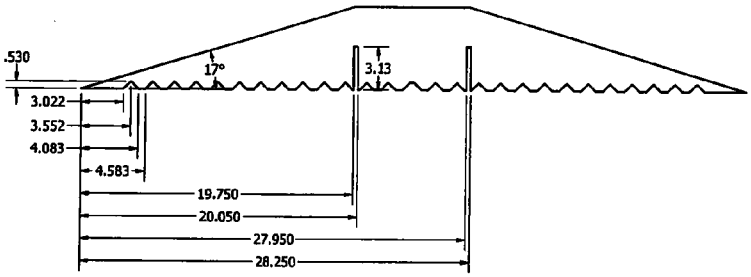
FIG. 7 is a side elevational view of the reinforcing rib of FIG. 5.
Figure 8:
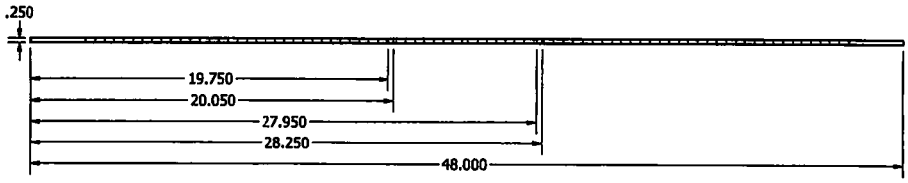
FIG. 8 is a top end view of the second reinforcing rib of the anchor protector.
Figure 9:
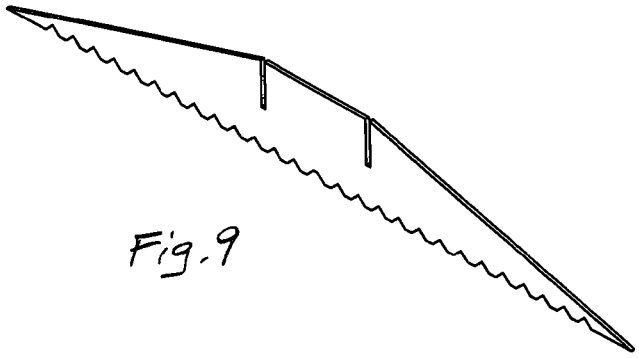
FIG. 9 is a top perspective view of the second reinforcing rib of FIG. 8.
Figure 10:
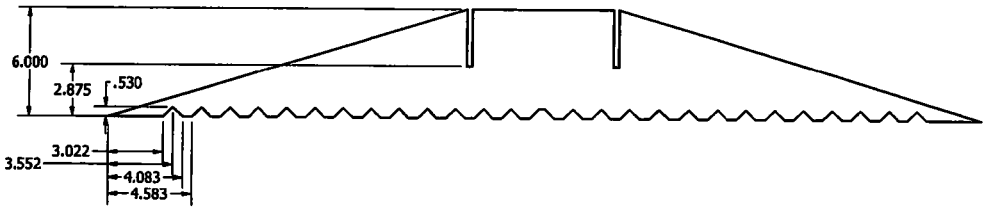
FIG. 10 is a side elevational view of the second reinforcing rib of FIG. 8.
Figure 11:
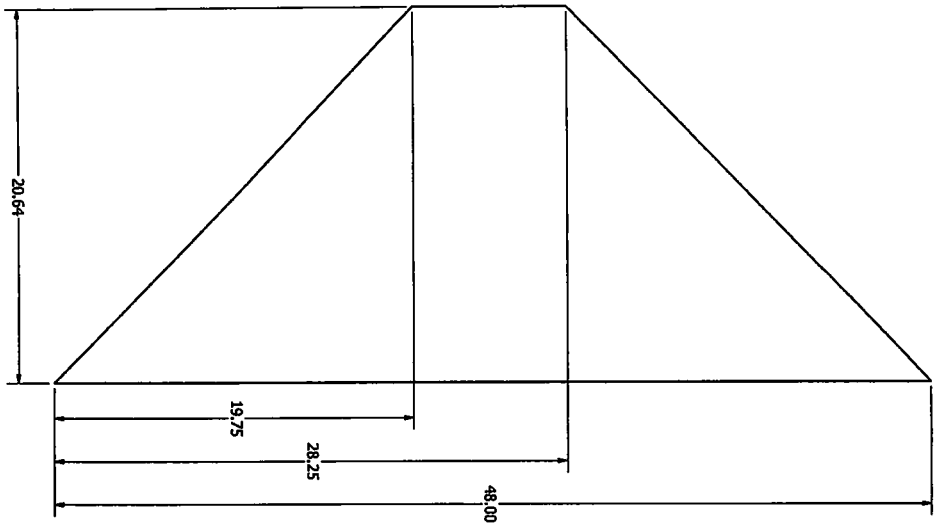
FIG. 11 is a top view of the side wall of the ground anchor of the invention.
Figure 12:
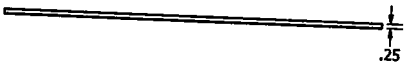
FIG. 12 is an end view of the side wall of FIG. 11.
Figure 13:
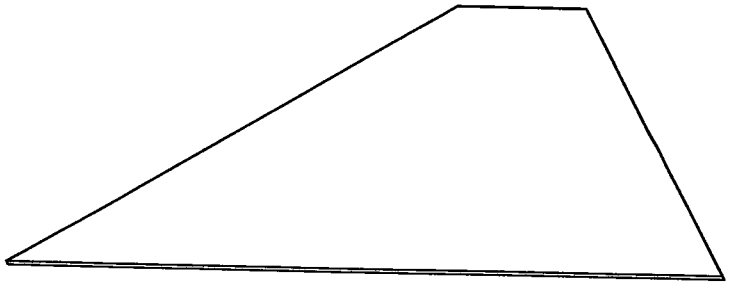
FIG. 13 is a side view of the side wall of the ground anchor in another embodiment of the invention.

The present invention is directed to an anchor rejected for protecting a guy wire or guide wire anchor embedded in the ground. The anchor protector has a substantially truncated pyramid shaped with four inclined walls converging at an incline to a central apex. In opening extends between the top face of the anchor protector and the bottom end of the anchor protector and has a dimension sufficient to receive the guy wire or guide wire anchor. The anchor protector has a height sufficient to fit over a guy wire or guide wire anchor to protect the anchor from damage and protect the anchor from being a tripping hazard. A pair of reinforcing ribs extends between the opposite walls and intersect with each other to define a passage extending between the top face of the anchor protector and the bottom end of the anchor protector.

What is claimed:

1. A drive over anchor protector for protecting a guy wire anchored in the ground, said protector comprising:

a first, second, third and fourth substantially flat inclined top wall converging to a central open top end, an axial passage having a dimension to receive the guy wire anchored in the ground and extending between the central open end and an open bottom end;

a first reinforcing rib and a second reinforcing rib, each reinforcing rib being spaced apart and parallel to each other and coupled to an entire inner surface of each of the first and second top walls and extending from the first top wall to the second top wall;

a third and a fourth reinforcing rib, each reinforcing rib being spaced apart and parallel to each other and coupled to an entire inner surface of said third and fourth top walls and extending from the third top wall to the fourth top wall, each said third and fourth reinforcing ribs intersecting with said first and second reinforcing ribs to define said axial passage extending between said open top end and said open bottom end.

2. The drive over anchor protector of claim 1, wherein said protector is manufactured with 0.25" ASTM a36 steel produced to a minimum yield of 36000 psi to provide rigidity and protect both the anchor and the equipment it is driven over.

3. The drive over anchor protector of claim 1, wherein said protector is painted with safety yellow for high visibility.

4. An anchor protector for protecting a guy wire anchor that is anchored in the ground, said protector comprising:

first and second inclined flat top walls converging from a first end and a second end to an opening in a top face of said anchor protector, a third and a fourth inclined flat top wall converging from a third end and fourth end to the opening in said top face of said anchor protector, said opening extending between said top face of said anchor protector and an open bottom face and having a dimension for receiving the guy wire anchor; and first and second parallel, spaced apart reinforcing ribs coupled to an inner surface of each of said first and second top walls and extending between said first end and second end and oriented adjacent said opening;

third and fourth parallel, spaced apart reinforcing ribs, each being coupled to an inner surface of said third and fourth top walls and extending between said third and fourth ends and oriented adjacent said opening;

said first and second reinforcing ribs having a top edge and a bottom edge with two spaced apart slots extending from said top edge toward said bottom edge;

said third and fourth reinforcing ribs having a top edge and a bottom edge with two spaced apart slots extending from said bottom edge toward said top edge, wherein said slots in said first and second reinforcing ribs receive said third and fourth reinforcing ribs, and said slots in said third and fourth reinforcing ribs receive said first and second reinforcing ribs to interlock said reinforcing ribs and to define said axial passage.

5. The anchor protector of claim 4, wherein said bottom edge of said first, second, third and fourth reinforcing ribs have a serrated ground engaging edge surface extending between the opposing ends of said anchor protector.

6. The anchor protector of claim 5, wherein each of said reinforcing ribs have a substantially trapezoidal shape with a substantially straight bottom edge, a substantially flat top edge opposite said bottom edge, and inclined edges extending between the bottom edge and the top edge, and where said slots in said first and second reinforcing ribs extend from an intersection between said inclined edges and said top edge, and said slots of said third and fourth reinforcing ribs extend from said bottom edge toward an intersection between the inclined edges and the top edge.

* * * * *